US005655851A

United States Patent [19]

Chor

[11] Patent Number: 5,655,851

[45] Date of Patent: Aug. 12, 1997

[54] SHORELINE EROSION CONTROL STRUCTURE

[76] Inventor: Ng Siew Chor, No. 50A, Main Road, Kepong 52100, Kuala Lumpur, Malaysia

[21] Appl. No.: 519,428

[22] Filed: Aug. 25, 1995

[30] Foreign Application Priority Data

Aug. 26, 1994 [MY] Malaysia ..... UI 940 2237
Aug. 26, 1994 [MY] Malaysia ..... PI 9402236

[51] Int. Cl.[6] ..... E02B 3/06

[52] U.S. Cl. ..... 405/31; 405/15; 405/21; 405/30

[58] Field of Search ..... 405/15, 21, 25, 405/27, 30, 31, 29

[56] References Cited

U.S. PATENT DOCUMENTS

| | | | |
|---|---|---|---|
| 1,971,324 | 8/1934 | Weber . | |
| 2,941,371 | 6/1960 | Benedict et al. . | |
| 3,386,250 | 6/1968 | Katayama . | |
| 3,757,527 | 9/1973 | Keller | 405/31 |
| 3,869,868 | 3/1975 | Irsai . | |
| 3,953,976 | 5/1976 | Morren et al. | 405/21 |
| 4,362,432 | 12/1982 | Conover . | |
| 4,407,608 | 10/1983 | Hubbard | 405/31 |
| 4,776,725 | 10/1988 | Brade . | |
| 4,804,294 | 2/1989 | Barthel | 405/21 X |
| 4,818,141 | 4/1989 | Rauch | 405/31 X |
| 5,160,215 | 11/1992 | Jensen . | |
| 5,178,489 | 1/1993 | Suhayda . | |

FOREIGN PATENT DOCUMENTS

| | | | |
|---|---|---|---|
| 745208 | 5/1933 | France | 405/31 |
| 2334789 | 7/1977 | France . | |
| 601652 | 2/1960 | Italy | 405/31 |
| 669001 | 6/1979 | U.S.S.R. | 405/31 |
| 634047 | 3/1950 | United Kingdom | 405/31 |
| WO9008230 | 7/1990 | WIPO . | |

*Primary Examiner*—Tamara L. Graysay
*Assistant Examiner*—Frederick L. Lagman
*Attorney, Agent, or Firm*—Weiser & Associates, P.C.

[57] ABSTRACT

A shoreline erosion control structure comprises a longitudinally extending upright wall portion (10) for installation across the path of oncoming sea waves (44) and a floor portion (12) extending laterally from the seaward side of said wall and slanting downwardly so as to cause oncoming waves to travel up the length of said floor facing and said wall. Preferably, the structure is made up of a plurality of contiguous units. The invention also includes a method of preventing soil erosion using the structure. The structure is provided with grounding means (22) which extends downwardly from the base of said wall portion (10) below the floor portion and which can be driven into the ground to keep the structure in the upright position.

10 Claims, 2 Drawing Sheets

FIG. 1
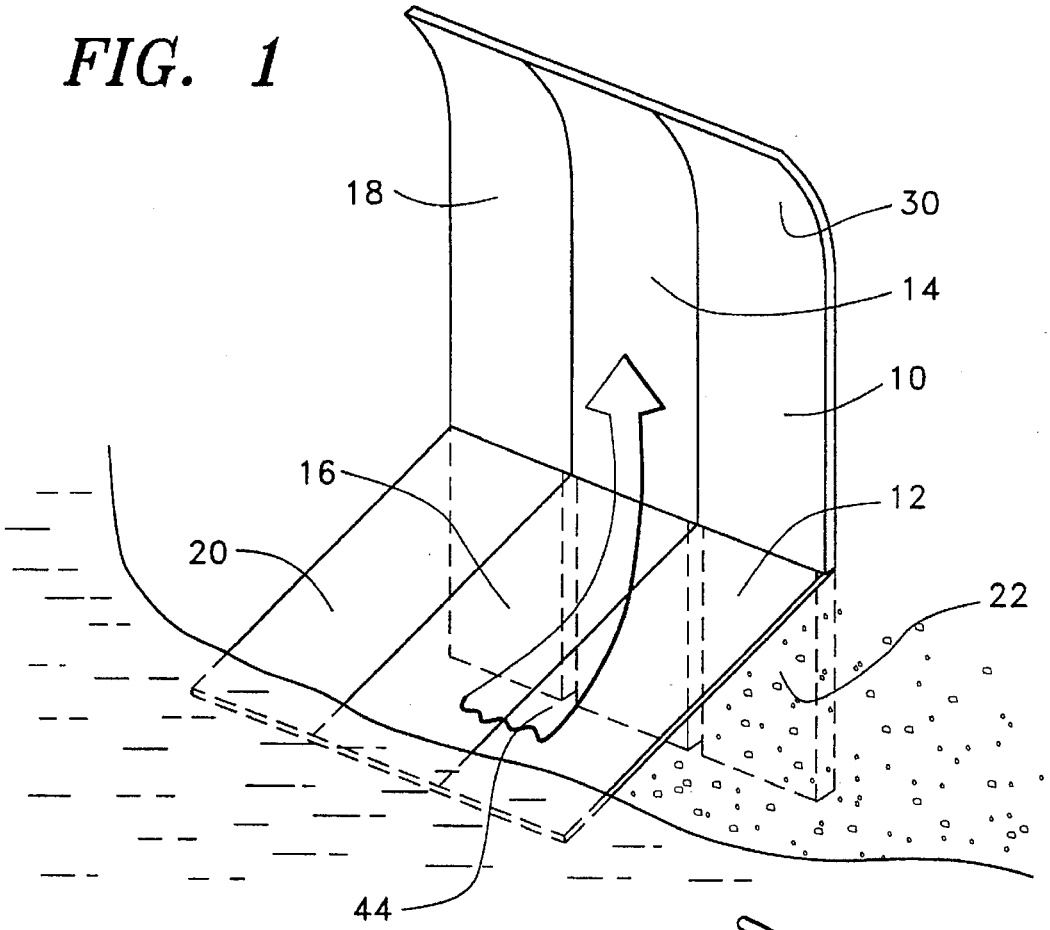
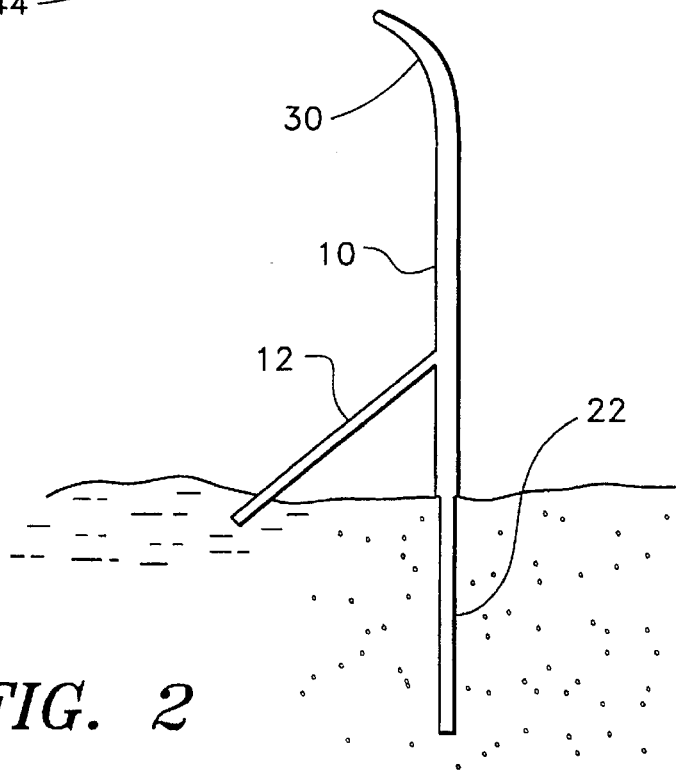
FIG. 2

SHORELINE EROSION CONTROL STRUCTURE

FIELD OF INVENTION

This invention relates to an erosion control structure built at the vicinity of beaches or river bays to minimize soil erosion caused by sea waves or river current.

BACKGROUND

Beaches are commonly subject to the attack of sea waves. This phenomenon has brought about enormous soil erosion to beaches and subsequently the permanent damage of these beaches. Beach erosion would not only mean the destruction of the otherwise useful land, but has indeed become a threat to the safety of property and human life.

Beach erosion are therefore become a matter of great concern for both the relevant government authorities as well as for the private individuals whose property and livelihoods are being threatened by the continuous harassment of strong tidal waves. This has incurred hundreds of millions of dollars spent to repair damaged beaches through the installation of different kinds of erosion control structure with the objective to arrest further damages thereof. However, the expenditure of such a huge sum is simply beyond the budget of many authorities and private individuals.

A few common methods have been used to reduce soil erosion at beaches caused by sea waves. One of them is by constructing a vertical concrete wall along the affected shoreline, serving as a shield and protecting the property concerned against the direct impact of the oncoming sea waves. This method is unsatisfactory because structurally, said concrete wall itself simply could not take on the direct impact by the oncoming sea waves and would soon be demolished.

Another common practice to reduce soil erosion at beaches is by the piling of mangrove wood piles along the shoreline concerned. Due to the physical limitations of such timber piles, the subsequent structure installed would not possess adequate strength to resist the continuous bombardment by the sea waves. In fact, there have been numerous incidences in which the timber piles are destroyed almost immediately after they are built and washed away by tidal waves hence failed to protect the shoreline concerned.

U.S. Pat. No. 5,178,489 has proposed a method to check soil erosion at beaches using waste tyres. Said tyres are made in float near the beach and arranged in a manner that they collectively serve as a barrier system to size down the energy of the oncoming sea waves. This method however involves the utilization of a large number of tyres and is therefore not practical. Further, waste tyres are not environmentally friendly and would cause pollution to beaches and their surroundings if drifted stray.

Both the prior arts disclosed in U.S. Pat. No. 5,160,215 and U.S. Pat. No. 3,386,250 involve massive and expensive installations. Moreover, these prior arts require a reasonably high degree of technology sophistication to build and therefore would likely to pose technical problems to the installers. The private individuals or even public authorities would be deterred from being involved in such soil erosion control projects due to the reasons mentioned above.

It is therefore, the main object of the present invention to provide a soil erosion control structure for beaches that is economical to manufacture, easy to install and can be maintained with low cost. It is also the primary purpose of the invention to ensure that the material used for the manufacture of the invention is easily available and environmentally friendly.

It is also the intention of the invention that it is applicable in other similar erosion control situations caused by the negative effect of other natural forces such as river current and rain water. The invention can therefore be used to control soil erosion in general. It therefore provides a suitable option for public authorities as well as private individuals when considering building a soil erosion infrastructure at beaches or in other relevant places.

The above and further objects of the invention will become apparent after consideration of the following description of the invention and its preferred embodiments detailed hereinafter.

SUMMARY OF INVENTION

According to the invention, there is provided a shoreline erosion control structure comprising a longitudinal uprightly erected wall installed across the path of oncoming sea waves and a floor facing which extends laterally from the seaward side of said wall downwardly seawardly in a slanting position so as to facilitate surfs of said oncoming waves to travel up the length of said floor facing and said wall.

DESCRIPTION OF DRAWINGS AND PREFERRED EMBODIMENTS

The invention will appear more clearly from the following detailed description when taken in connection with the accompanying drawings showing by way of example only, preferred embodiments of the inventive idea.

IN THE DRAWINGS:

FIG. 1 is a perspective view of a first preferred embodiment of the shoreline erosion control structure in accordance with the invention, FIG. 2 is the side view of the shoreline erosion control structure shown in FIG. 1.

Figure 3:
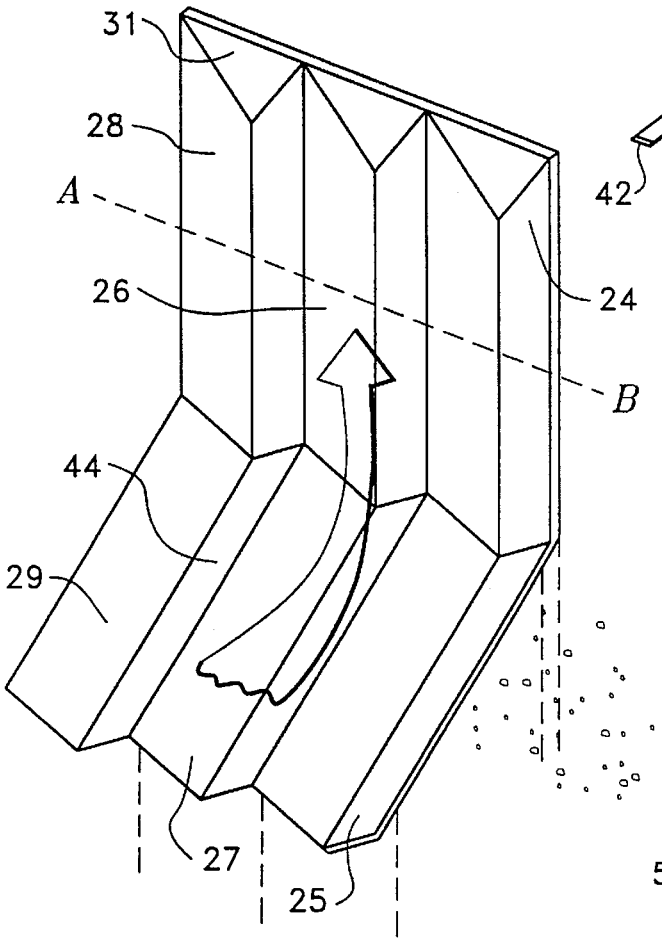
FIG. 3 is a perspective view of a second preferred embodiment of the shoreline erosion control structure in accordance with the invention.

Referring to FIG. 1, there is shown a preferred embodiment of the erosion control structure in which a longitudinal wall 10 is erected in an upright position along the shoreline of a beach under consideration, with the plane surface of said wall facing the sea and across the path of the oncoming waves. Extending downwardly from the lower end of said wall is a grounding means 22 which means has been piled into the soil of the beach in order to install said wall in the present position. Piling work of such kind can be achieved by any common engineering practice available in the market.

Extending laterally from the seaward side of the longitudinal uprightly erected wall 10 is a floor facing 12 as shown in FIG. 1. Said floor facing slants downwardly seawardly until its remote end submerges just below the sea level. Apparently, said floor facing has been intentionally installed at a level so as to receive the surf of sea wave 44 and to facilitate it to travel up the length thereof.

The uppermost portion of the seaward side of the uprightly erected wall 10 has been curved seawardly in an upward direction and terminated in a crescent-shaped configuration 30. However, the top end of said wall 10 may also assume other configuration. For instance, one common configuration is a straight portion without any curvature at its end.

FIG. 1 illustrates that similar longitudinal upright unit walls 14, 18 are installed next to said wall 10. Installation is via the piling of the respective grounding means thereof. Hence, unit walls 10, 14, 18 are installed in a position such that to form a continuous wall that lies uprightly across the path of the oncoming sea waves. The upper portions on the seaward side of the wall surface formed by all the units have been provided with configurations 30 which are identical with each other, thus enlarging the existing continuous wall below. It is understood from FIG. 1 and FIG. 2 that the upper configurations of said unit walls 10, 14, 18 are of crescent shape, with their seaward surface curving seawardly upwardly.

Similarly, floor facings 16, 20 are provided to unit walls 14, 18 in a manner as the floor facing 12 has been provided to unit wall 10. These two floor facings exist in close proximity with each other and with said floor facing 12 in a side-by-side position to form a continuous platform or larger floor facing. Said larger floor facing extends seawardly downwardly until its remote end submerges into the sea water in a position ready to receive the oncoming sea wave 44.

Hence, said oncoming sea wave 11 travels upwardly along the floor facing 12, 16, 20. Along the way, it dissipates energy due to its own gravity. When it arrives at the foot of the uprightly erected unit walls 10, 14, 18 of the shoreline erosion control structure, part of the wave changes course and surfs upwardly outwardly in some sort of circular movement due to its own inertia acquired when travelling up said slanting floor facings. Some water that is involved in said movement will drop off the surf of the sea wave and fall back onto said floor facings.

For the remainder of the surf which was successfully travelled up the straight portion of the unit walls 10, 14, 18 of said erosion control structure. It will be guided further on by the wall surface until reaching the curved configuration 30 at the top portion of said walls. Travelling through said curved configuration, the water in the wave will be swirled in a circular motion. When it leaves said curved configuration, said water will be thrown back onto the floor facings 12, 16, 20. To a substantial extent, the fallen water will provide a sort of braking effect on the next arriving wave, hence becoming a retarding factor in dissipating the energy carried in this next wave. This happening will help reduce the impact of the wave on said unit walls 10, 14, 18.

In beaches which are frequented by strong tidal waves having high surfs, it is then understood that the vertical length of the unit walls 10, 14, 18 shall be adapted with sufficient height so as to adequately cut down the energy of the oncoming surfing waves during their journey of travelling up to the upper end of said walls. When said waves leave said end of the walls, they would have already dissipated almost all of their energy and would not be able to travel further distance in the upward direction. In this way, water in the waves will not be splashed over and beyond the head of said unit walls in the landward direction and causing soil erosion thereto.

In the construction of the shoreline erosion control structure, unit walls of different shape and configuration may be utilized. In FIG. 1, the unit walls 10, 14, 18 are in the shape of elongated flat plates. FIG. 3 however demonstrates another embodiment of unit walls comprising tubular plates of V-shape cross-section, which are installed vertically as unit walls 24, 26, 28.

Figure 4:
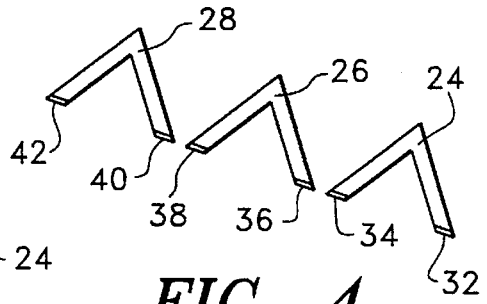
FIG. 4 is the cross-sectional exploded view of the unit walls of the second embodiment of the shoreline erosion control structure in accordance with the invention as shown in FIG. 3 along the line 4—4.

These unit walls consist of engagement means 32, 34, 36, 38, 40, 42 at the terminals of their open lateral V-shape arms as shown in FIG. 4. Said engagement means are adapted to connect with those of the adjacent ones when said unit walls 24, 26, 28 are aligned alongside with each other.

In FIG. 3, the unit walls with V-shape cross-section 24, 26, 28 are erected uprightly close with each other, with their open arms facing the sea. The engagement means of a particular unit wall will engage with the engagement means of the adjacent unit wall to form a continuously wall. Floor facings 25, 27, 29 extend from the lower portion of said V shape unit walls 24, 26, 28 respectively, in the seaward and downward direction. Such facings collaborate with each other in the same way as those facings do in the first embodiment to form a continuous large floor facing. At the upper end of each of said tubular unit walls, there is provided with a roofing surface 11 which tilts seawardly and upwardly from the vertex of the V shape cross-sectional end thereof. It is obvious that the physics involved in dissipating the energy of the surf of sea waves for this embodiment is basically the same as that for the embodiment mentioned in FIG. 1.

Figure 5:
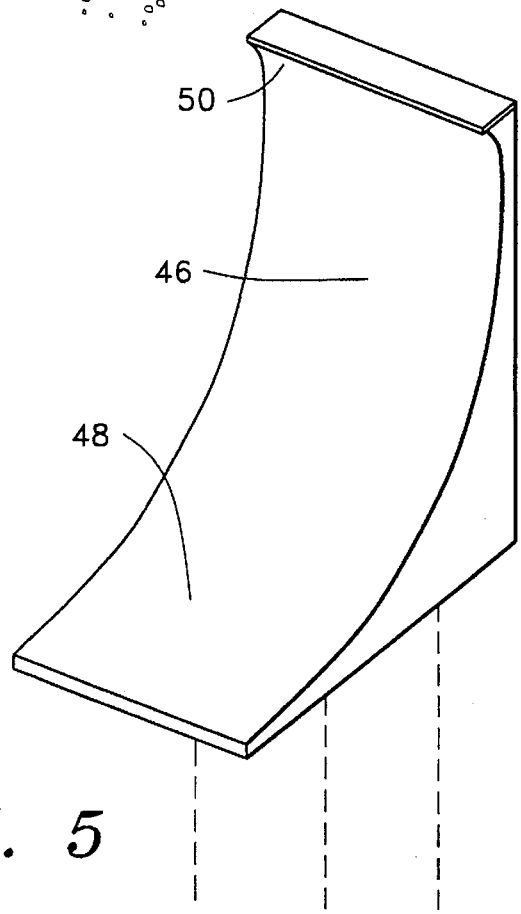
FIG. 5 is a perspective view of a third preferred embodiment of the shoreline erosion control structure in accordance with the invention.

FIG. 5 illustrates yet another embodiment of a shoreline erosion control structure constructed in a different form. There is disclosed a floor facing 48, a unit wall 46 abutted with curved configuration 50 on its upper end, with the whole structure being east as an integral prism-like unit structure in concrete or other rigid material. As can be seen, said prism-like structure is further provided with a grounding means 52 which extends vertically downward from the base thereof. Said grounding means is to be piled into the soil of the beach concerned in order to erect the unit wall 46 in an upright position.

A plurality of such prism-like unit structures are manufactured and installed with all the unit walls facing the sea in a side-by-side arrangement such that component wall 46 of a particular unit cooperates with counterpart wall of the adjacent unit to form a continuous wall surface, just as have been achieved by unit walls 10, 14, 18 in the first embodiment as shown in FIG. 1. Component floor facing 48 and curved configuration 50 on the upper end in each of these units also cooperate with their counterparts in the adjacent unit in the same manner described above. In other words, a plurality of said prism-like unit structure are assembled in the manner stated above to form an identical larger unit structure with all unit walls erected right across the path of the incoming seal waves.

Resembling the design principles of the embodiment in FIG. 1, the seaward side of the uprightly erected unit wall 46 of the prism-like structure as shown in FIG. 5 curves seawardly downwardly at the lower portion where it interphases with the floor facing 48 at the floor of the structure. When travelling up said floor facing, an oncoming wave, not shown in the figure will first experience the gravitational force due to its own weight because of the gradient of said floor facing. When it reaches the curved inter-phase region between said floor facing and said upright unit wall, the wave is deflected further on seawardly upwardly, creating surf in circular movement just as in the case of the earlier embodiment as shown in FIG. 1. Likewise, the energy carried by the sea wave will be dissipated in the same manner as discussed in that embodiment.

From the aforementioned, clearly the height of the unit wall 46 in FIG. 5 is actually a design choice based on the estimation of the strength of the sea waves in a particular vicinity. The height of said wall shall be adapted to be able to adequately dampen the surf of the wave before the later is deflected away at the uppermost curved configuration 50 thereof, sending the water back to the integral floor facing 48 again and causing retarding effect on the next wave that comes along.

From the construction point of view, the material used to manufacture the above prism-like structure has an influence on its own rigidity and stability. Prisms made of reinforced concrete have been proven to be a good choice because of their heavy weight and immunity to sea water. It is also an important engineering practice that the grounding means 52 shall be of sufficient length and strength so as to ensure stability of the whole erosion control structure once installed in position.

Although the present invention has been directed specifically to a soil erosion control structure used to protect shoreline against erosion caused by sea waves, it may also be used to control erosion in other places, for example soil erosion happening to hill slope along motor roads. Therefore, apparently variations and modifications of the presently disclosed erosion control structure may occur to those skilled in the art, especially after benefiting from the teaching of the invention. However, such variations and modifications are within the scope and spirit of the invention claimed hereinafter.

I claim:

1. An erosion control structure for resting upon a ground surface, comprising a substantially vertical wall portion, a grounding portion attached to the wall portion for being driven into the ground to hole the wall portion in the substantially vertical position, and a floor portion co-extensive with the wall portion and extending travsversely of and outwardly from the wall portion at a level substantially at a transition between the wall portion and the grounding portion and slanting downwardly in the direction of the grounding portion, wherein the wall portion is formed by a plurality of elongate units having a V-shaped section and connected together along lateral edges, and wherein the units have a closure at one end to form an upwardly inclined roof portion in the wall portion.

2. The erosion control structure of claim 1 wherein the wall portion and the grounding portion are formed as a unitary structure.

3. The erosion control structure of claim 2 wherein the units forming the wall portion and the grounding portion, and the floor portion, are tubular.

4. The erosion control structure of claim 1 wherein channels defined by the V-shaped units forming the floor portion are aligned with channels defined by the V-shaped units forming the wall portion.

5. An erosion control structure for resting upon a ground surface, comprising a substantially vertical wall portion, a grounding portion attached to and aligned with the wall portion for being driven into the ground to hold the wall portion in the substantially vertical position, and a floor portion co-extensive with and connected to the wall portion, and extending travsversely of and outwardly from the wall portion at a location substantially at a transition between the wall portion and the grounding portion and slanting downwardly in the direction of the grounding portion, wherein the wall portion and the floor portion are each formed of a plurality of elongate units having a V-shaped section and connected together along lateral edges.

6. The erosion control structure of claim 5 wherein the wall portion and the grounding portion are formed as a unitary structure.

7. The erosion control structure of claim 6 wherein the units forming the wall portion and the grounding portion, and the floor portion, are tubular.

8. The erosion control structure of claim 5 wherein upper ends of the units forming the wall portion are closed and cooperate to form a roof portion.

9. The erosion control structure of claim 5 wherein channels defined by the V-shaped units forming the floor portion are aligned with channels defined by the V-shaped units forming the wall portion.

10. A method of erecting an erosion control structure on a ground surface, which comprises the steps of driving a plurality of elongate units having a V-shaped section substantially vertically into the ground in close proximity to each other and connecting adjacent units together along lateral edges to form a wall; providing at the wall and substantially level with the ground a plurality of V-shaped units corresponding to the units forming the wall and arranged to form a downwardly slanting floor, wherein one floor unit is associated with each wall unit and wherein each floor unit has an end formed to fit closely into the V-shaped section of the wall unit so that lateral edges of the floor unit and the wall unit are aligned, and connecting adjacent floor units to each other and to the wall units to form a rigid structure.

* * * * *